US005655294A

United States Patent [19]

Makino

[11] Patent Number: 5,655,294

[45] Date of Patent: Aug. 12, 1997

[54] METAL TERMINAL INSERTION TOOL AND METHOD FOR INSERTING A METAL TERMINAL WITHIN A CONNECTOR HOUSING

[75] Inventor: Hirotaka Makino, Yokkaichi, Japan

[73] Assignee: Sumitomo Wiring Systems, Ltd., Mie, Japan

[21] Appl. No.: 496,663

[22] Filed: Jun. 29, 1995

[30] Foreign Application Priority Data

Jul. 28, 1994 [JP] Japan ..... 6-197991

[51] Int. Cl.[6] ..... H01R 9/00

[52] U.S. Cl. ..... 29/845; 29/278; 29/270; 29/750

[58] Field of Search ..... 29/748, 750, 751, 29/752, 762, 842, 844, 845, 270, 278, 280

[56] References Cited

U.S. PATENT DOCUMENTS

| | | | |
|---|---|---|---|
| 2,661,487 | 12/1953 | Hicks et al. | 29/270 |
| 3,010,193 | 12/1961 | Croall, Jr. et al. | 29/278 |
| 3,074,155 | 1/1963 | Cootes et al. | 29/278 |
| 3,871,057 | 3/1975 | Moulin . | |
| 4,501,054 | 2/1985 | Morgan | 29/278 |
| 5,177,846 | 1/1993 | Bryant | 29/278 |

FOREIGN PATENT DOCUMENTS

| | | |
|---|---|---|
| 83 33 705 | 3/1984 | Germany . |
| 62-282875 | 12/1987 | Japan . |
| 1-62690 | 4/1989 | Japan . |

*Primary Examiner*—P. W. Echols
*Assistant Examiner*—Adrian L. Coley
*Attorney, Agent, or Firm*—Oliff & Berridge

[57] ABSTRACT

To facilitate the insertion of a metal terminal with a waterproof seal into a cavity, a tool is provided with a stepped tubular portion and a grip portion connected to the tubular portion. The stepped tubular portion has, in one embodiment, four cylindrical portions having different outer diameters, and the outer diameters decrease stepwise toward a distal end of the tubular portion. A slit is formed in the tubular portion and extends from the distal end thereof into the fourth cylindrical portion. The slit has a width so as to allow a wire to pass therethrough. With this construction, the distal end of the cylindrical portion can easily push the waterproof seal without deformation.

14 Claims, 9 Drawing Sheets

METAL TERMINAL INSERTION TOOL AND METHOD FOR INSERTING A METAL TERMINAL WITHIN A CONNECTOR HOUSING

BACKGROUND OF THE INVENTION

This invention relates to a metal terminal insertion tool for mounting a waterproof seal into a waterproof connector housing. This invention also relates to a method for inserting a metal terminal within a connector housing.

Generally, a waterproof seal used in a waterproof connector is made of rubber and is fixedly secured, together with a wire, to a metal terminal by compressive clamping. When the metal terminal is inserted into a cavity in a connector housing while holding the wire by hand, the waterproof seal is also inserted into the cavity and brought into intimate contact at its outer periphery with an inner surface of the cavity, thereby forming a watertight seal.

During insertion of the metal terminal, when the waterproof seal begins to be press-fitted into the cavity, a large frictional resistance to movement of the waterproof seal is suddenly encountered. Therefore, when pushing the metal terminal into the cavity while holding the wire merely with the fingers, the narrow wire is often bent or buckled, so that the metal terminal and the waterproof seal cannot be easily brought into their respective proper positions. As a result, the entire assembly is held in an incompletely inserted position, and the waterproof seal is inserted in a tilted manner. This causes incomplete retaining of the metal terminal and incomplete watertight sealing.

To prevent this, it has heretofore been necessary to push the waterproof seal deep into the cavity using a narrow, bar-like tool, such as a precision screw driver, to bring the waterproof seal and the metal terminal into their respective proper positions.

However, in the operation in which the above narrow, bar-like tool is used, the point of application of the force on the peripheral portion of the waterproof seal must be sequentially adjusted to ensure proper fitting of the seal. This is a time-consuming and troublesome operation.

SUMMARY OF THE INVENTION

The present invention has been made in order to overcome the above problems, and an object of the invention is to provide a metal terminal insertion tool by which metal terminals with respective waterproof seals can be easily pushed into their respective cavities.

The above object, according to a first aspect of the invention, has been achieved using a metal terminal insertion tool that includes a tubular portion engageable with a waterproof seal at a distal end thereof. The tubular portion has a slit extending from the distal end thereof, the slit having such a width that the slit can receive a wire therein.

The tubular portion may have a stopper for limiting the depth of insertion of the tubular portion into an insertion passage. The tubular portion can have a stepped configuration such that an outer diameter of the tubular portion is reduced stepwise toward its distal end.

According to a second aspect of the present invention, there is provided an insertion tool for inserting a metal terminal and its associated waterproof seal within a connector housing comprising a grip portion and a tubular portion connected to the grip portion, the tubular portion including a distal end engageable with the waterproof seal, the grip portion being pushed towards the connector housing to insert the metal terminal within the connector housing until a stopper portion formed on the tubular portion engages an insertion port of the connector housing.

According to a third aspect of the present invention, there is provided a method for inserting a metal terminal and its associated waterproof seal through an insertion passage of a connector housing. The method comprises engaging a distal end of a tubular portion of the insertion tool with substantially an entire periphery of the waterproof seal, and sliding the metal terminal and the waterproof seal into the insertion passage of the connector housing by pushing a grip portion of the insertion tool, which is attached to the tubular portion, towards an insertion port of the connector housing.

For mounting a metal terminal in a connector housing, the wire is first held by the fingers, and is inserted into a cavity, so that the waterproof seal (integrally connected to the metal terminal) is fitted into the cavity. Then, the tool is held by the hand, and the wire is received into the bore of the tubular portion through the slit in the tubular portion, and the distal end of the tubular portion is brought into engagement with the waterproof seal. The tubular portion is pushed into the cavity, so that the entire waterproof seal is pushed in one motion into the cavity together with the metal terminal. It is also possible that the metal terminal and its associated waterproof seal are first attached to the tool, and the entire assembly is inserted into the connector housing.

When a stopper is provided on the tubular portion, the stopper limits the depth of insertion of the tubular portion. Therefore, when the waterproof seal reaches its proper position, the stopper prevents the tubular portion from being pushed in further.

When the tubular portion has a stepped configuration such that its outer diameter is reduced stepwise toward its distal end, if the distal end portion of the tubular portion is cut off, the diameter of the distal end of the tubular portion can be increased. Furthermore, the diameter of the distal end can be varied in a stepped manner. Therefore, by cutting the distal end portion of the tubular portion at a suitable position, the diameter of the distal end of the tubular portion can be determined in accordance with the outer diameter of the waterproof seal and the inner diameter of the cavity.

As described above, in the present invention, the distal end of the tubular portion can push the waterproof seal uniformly over substantially the entire peripheral portion thereof, and therefore the waterproof seal can be pushed in straight, thereby enhancing a waterproof effect. Moreover, it is not necessary to change the position of pushing of the waterproof seal sequentially around the outer peripheral portion thereof so that the waterproof seal will not be deformed or tilted at a localized portion thereof as in the conventional construction. Instead, it is only necessary to push the tubular portion in one motion into a predetermined position. This achieves an advantage that the efficiency of the operation is very good. In addition, the stopper prevents the waterproof seal from being excessively pushed so that a constant quality can be secured. Moreover, by cutting the tubular portion at a suitable portion thereof, the distal end of the tubular portion can be determined in accordance with the outer diameter of the waterproof seal and the inner diameter of the cavity. Therefore, the tool is suitable for installation of many different types of connectors.

These and other aspects and advantages of the present invention are described in or apparent from the following detailed description of preferred embodiments.

BRIEF DESCRIPTION OF THE DRAWINGS

Preferred embodiments are described with reference to the drawings in which.

DETAILED DESCRIPTION OF PREFERRED EMBODIMENTS

A first embodiment of the present invention will now be described with reference to FIGS. 1 to 3.

A metal terminal insertion tool of this embodiment is used for inserting a metal terminal with a waterproof seal into a connector housing of a waterproof connector. Reference is first made to the waterproof connector used in connection with the present invention.

Figure 3:
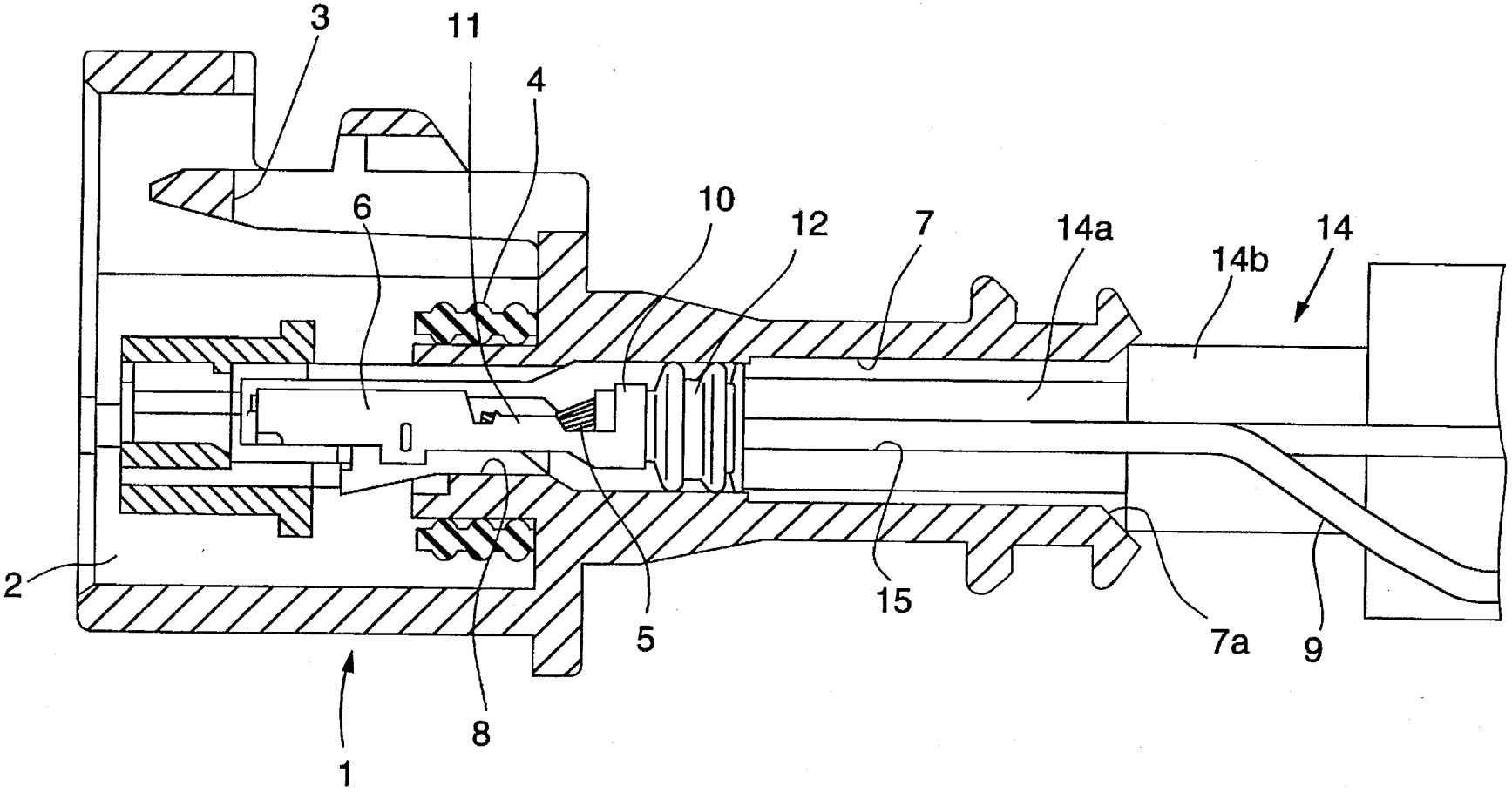
FIG. 3 is a cross-sectional view showing a condition in which the insertion of the metal terminal is finished.

As shown in FIG. 3, the connector housing 1 is of a conventional construction and includes a hood portion 2 for receiving a mating connector, a lock portion 3 for locking engagement with the mating connector, a waterproof seal 4 for the housing, and a cavity 5. One end of the cavity 5, remote from the hood portion 2 of the connector housing 1, defines an insertion port 7*a* for the passage of the metal terminal 6 therethrough, and the cavity 5 has an insertion passage 7 and a terminal receiving chamber 8 disposed inwardly of the insertion passage 7 for receiving the metal terminal 6.

The metal terminal 6 is of a conventional construction, and includes an insulation barrel 10 for gripping an insulating sheath of a wire 9 and a wire barrel 11 for gripping a conductor of the wire 9. The insulation barrel 10 is compressively deformed against the waterproof seal 12 to grip the insulating sheath, the waterproof seal 12 being press-fitted into the cavity 5.

Figure 1A:
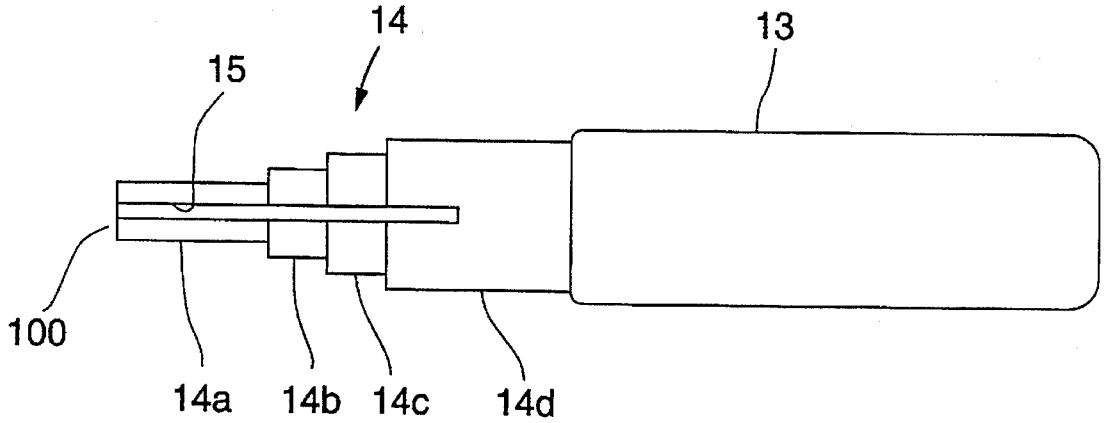
FIG. 1(A) is a side-elevational view showing an overall construction of a first embodiment.
Figure 1B:
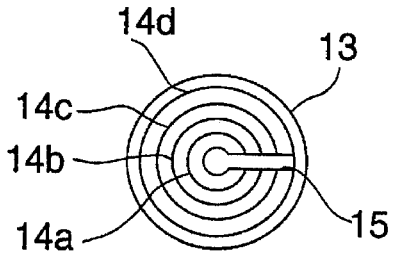
FIG. 1(B) is a front-elevational view of the first embodiment.
Figure 2:
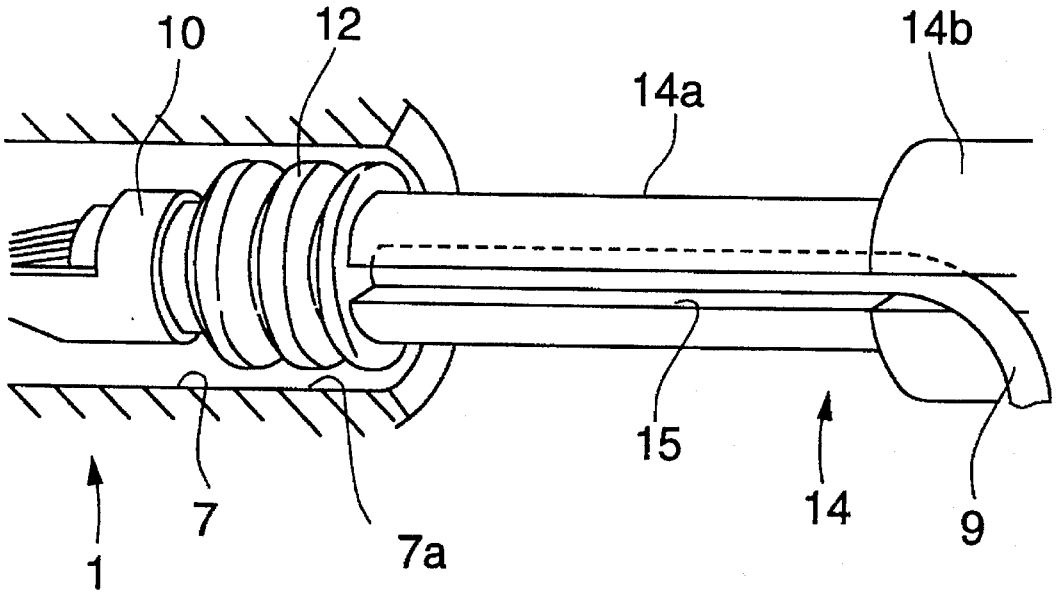
FIG. 2 is a perspective view showing an initial stage of the insertion of a metal terminal in the first embodiment.

The metal terminal insertion tool of this embodiment includes a grip portion 13, and a stepped tubular portion 14 extending from one end of the grip portion 13, as shown in FIGS. 1(A) and 1(B). The metal terminal insertion tool is made of a synthetic resin having a hardness such that it can be cut off using a cutter or the like. The stepped tubular portion 14 has four cylindrical portions 14*a* to 14*d* having different outer diameters. The outer diameters decrease in size in a direction from the grip portion 13 towards the distal end 100 of the tubular portion 14. A slit 15 is formed in the tubular portion 14, and axially extends from the distal end 100 into the fourth cylindrical portion 14d. The slit 15 has a width so as to allow the wire 9, which is connected to the metal terminal 6, to pass through the slit 15 (FIG. 2).

A method for mounting the metal terminal 6 using the metal terminal insertion tool will now be described. For inserting the metal terminal 6 into the terminal receiving chamber 8 in the connector housing 1, the wire 9 connected to the metal terminal 6 is first held by the fingers, and the terminal 6 is inserted into the insertion passage 7 through the insertion port 7*a*, so that the waterproof seal 12 is located near the insertion port 7*a*. A portion of the wire 9 extending towards the outside of the waterproof seal 12 is received into the bore of the tubular portion 14 through the slit 15. Accordingly, the wire 9 is introduced into the distal end 100 of the tubular portion 14, and the distal end 100 of the tubular portion 14 is abutted against the waterproof seal 12 (see FIG. 2). At this time, since the wire 9 is received in the tubular portion 14, the distal end of the tubular portion 14 can be held against the waterproof seal 12 uniformly over substantially the entire peripheral portion thereof. Then, the grip portion 13 is pushed towards the metal terminal 6 to force the waterproof seal 12 deep into the cavity 5, so that the metal terminal 6 moves along the insertion passage 7 and becomes received in the terminal receiving chamber 8. In this case, by merely pushing the tubular portion 14 deep into the insertion passage 7, the waterproof seal 12 can be inserted straight without being tilted, so that the outer peripheral surface of the waterproof seal 12 is held in intimate contact with the inner peripheral surface of the insertion passage 7, thereby achieving a good sealing effect.

In the case where the inner diameter of the insertion passage 7 of the cavity 5 is larger than the outer diameter of the cylindrical portion 14*a*, and is smaller than the outer diameter of the cylindrical portion 14*b*, the cylindrical portion 14*b* is brought into engagement with the peripheral edge portion of the insertion port 7*a* in the connector housing 1 to form a stop by limiting the depth of insertion of the tubular portion 14 when the metal terminal 6 is received in the terminal receiving chamber 8 and upon full insertion of the cylindrical portion 14*a* into the insertion passage 7, as shown in FIG. 3. Therefore, the waterproof seal 12 is prevented from being excessively pressed, and the metal terminal 6 and the waterproof seal 12 can be positively pushed into their respective proper positions without fail.

If the inner diameter of the insertion passage 7 is larger than the outer diameter of the cylindrical portion 14*b*, and is smaller than the outer diameter of the cylindrical portion 14*c*, the cylindrical portion 14*c* is brought into engagement with the connector housing 1 to limit the depth of insertion of the tubular portion 14.

Thus, in this embodiment, when forcing the waterproof seal 12 into the cavity, the distal end of the tubular portion 14 can simultaneously push the entire circumference of the waterproof seal 12, and therefore the waterproof seal can be inserted straight, thereby achieving a high waterproof effect. Moreover, because the entire waterproof seal 12 is pushed in one motion, it is not necessary to change the position of pushing of the waterproof seal 12 sequentially around the outer peripheral portion thereof as in the conventional construction. Instead, it is only necessary to push the tubular portion 14, and therefore the operation can be carried out easily. Furthermore, in this embodiment, the tubular portion 14 has a stepped configuration, and when the metal terminal 6 is pushed into the proper position, the cylindrical portion 14*b* is abutted against the edge portion of the insertion port 7*a* in the connector housing 1. Therefore, it is only necessary to push the tubular portion 14 until the cylindrical portion 14*b* is brought into engagement with the above edge portion, so that good efficiency of the operation is achieved.

Because the tubular portion 14 has a hardness such that it can be cut off, the tubular portion 14 can be cut in accordance with the outer diameter of the waterproof seal 12 or the inner diameter of the insertion passage 7. For example, if the outer diameter of the waterproof seal 12 is slightly larger than the outer diameter of the cylindrical portion 14*b*, the cylindrical portion 14*a* can be cut off from the tubular portion 14, and the waterproof seal 12 can be pushed by the cylindrical portion 14*b*. Namely, a suitable one of the cylindrical portions that has an appropriate diameter can be selected in accordance with the outer diameter of the waterproof seal 12. Moreover, the tubular portion 14 can be cut off in accordance with a predetermined depth of insertion thereof, and therefore even if the depth of insertion is different from that mentioned in the above embodiment, the next-stage cylindrical portion can effectively function as a stopper. Therefore, many kinds of connectors can be dealt with using one kind of tool.

The present invention is not limited to the above embodiment and the following modifications can be made, which fall within the scope of the invention.

Figure 4A:
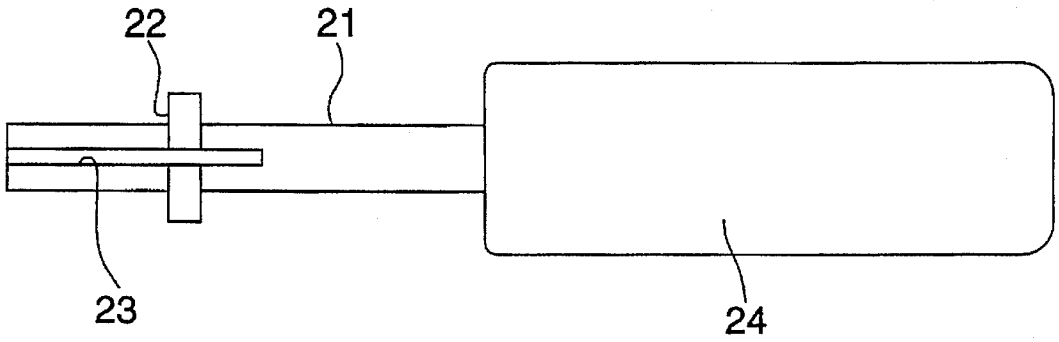
FIG. 4(A) is a side-elevational view showing an overall construction of a second embodiment having a flange.
Figure 4B:
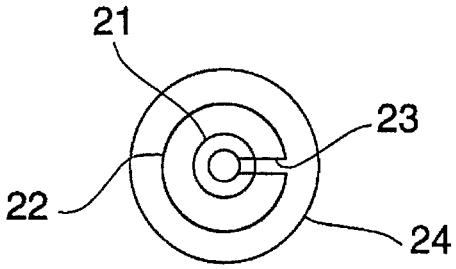
FIG. 4(B) is a front-elevational view of the second embodiment.

(1) In the first embodiment, the tubular portion 14 has a stepped configuration and the cylindrical portion 14*b* functions as a stopper for limiting the depth of insertion of the tubular portion 14. However, such a construction as shown in FIGS. 4(A) and 4(B) may be adopted.

A tubular portion 21, having a uniform diameter throughout its length from its distal end to its proximal end, extends from one end of a grip portion 24, and a flange 22 is formed on a predetermined portion of the tubular portion 21 spaced from the distal end thereof. This flange 22 serves as a stopper. A slit 23 is formed in the tubular portion 21, and extends from the distal end of the tubular portion to a generally central portion thereof through the flange 22. The slit 23 can receive the wire, which is clamped to the metal terminal together with the waterproof seal. The waterproof seal can be easily pushed by this tool without deforming the seal by the distal end of the tubular portion 21. Therefore, advantageously, a waterproof effect can be enhanced. Also, the efficiency of the operation can be enhanced, as in the first embodiment. In addition, the flange 22 can be adjustably mounted in fixed position to fix the terminal insertion depth.

Figure 5A:
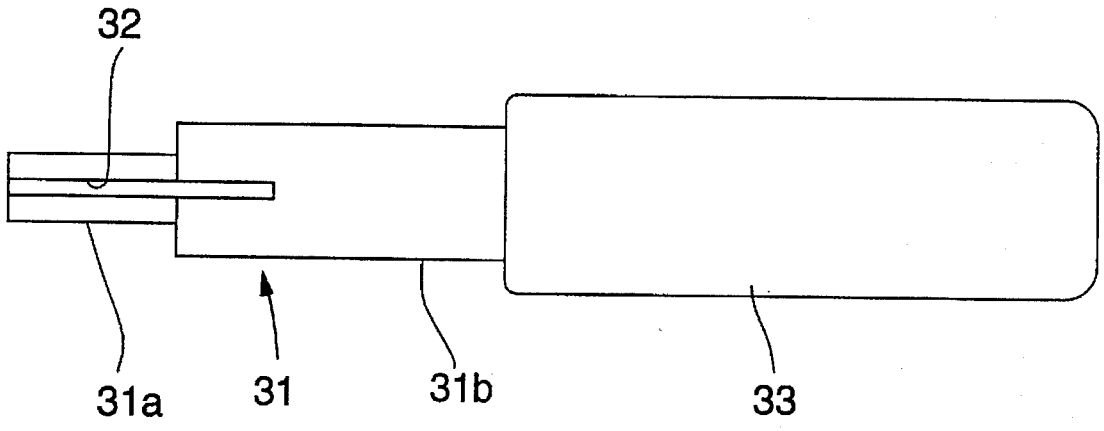
FIG. 5(A) is a side-elevational view showing an overall construction of a third embodiment having a two-step configuration.
Figure 5B:
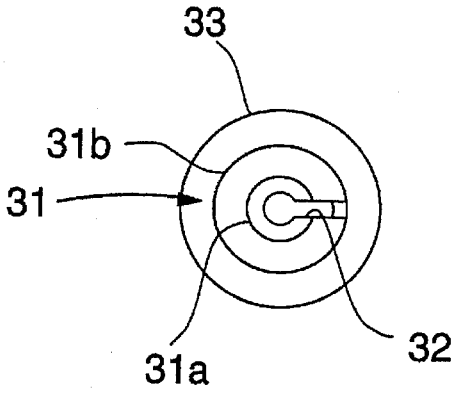
FIG. 5(B) is a front-elevational view of the third embodiment.

(2) In the first embodiment, although the tubular portion 14 has the stepped configuration, that is, the four cylindrical portions are different in outer diameter, the number of these steps is not limited to four, and such a construction as shown in FIGS. 5(A) and 5(B) may be adopted.

A tubular portion 31, having two cylindrical portions of different outer diameters, extends from one end of a grip portion 33, and is narrowed stepwise toward the distal end thereof. A slit 32 is formed in the tubular portion 31, and extends from the distal end of the cylindrical portion 31a into the cylindrical portion 31*b*. This slit 32 can receive the wire, which is clamped to the metal terminal together with the waterproof seal. In this case, the cylindrical portion serves as a stopper. With this construction, the waterproof seal can be easily pushed without deforming the seal by the distal end of the cylindrical portion 31*a*, and therefore, advantageously, a waterproof effect can be enhanced. Also, efficiency of the operation can be enhanced as in the above embodiments.

Figure 6A:
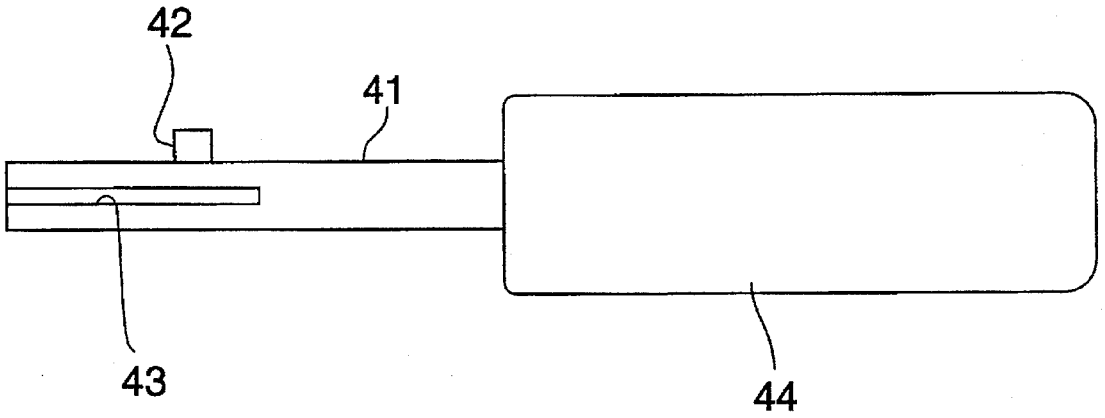
FIG. 6(A) is a side-elevational view showing an overall construction of a fourth embodiment having one projection.
Figure 6B:
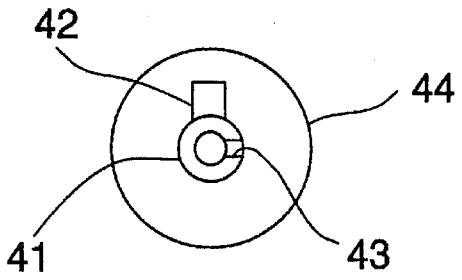
FIG. 6(B) is a front-elevational view of the fourth embodiment.

(3) In the first embodiment, the tubular portion 14 has the stepped configuration and the cylindrical portion 14*b* serves as the stopper for limiting the depth of insertion of the tubular portion. However, such a construction as shown in FIGS. 6(A) and 6(B) may be adopted.

A tubular portion 41, having a uniform diameter throughout its length from its distal end to its proximal end, extends from one end of a grip portion 44, and a projection 42 is formed on a predetermined portion of the tubular portion 41 spaced from the distal end thereof. This projection 42 serves as a stopper. A slit 43 is formed in the tubular portion 41, and extends from the distal end to a position in the vicinity of the projection 42. The slit 43 can receive the wire, which is clamped to the terminal together with the waterproof seal. With this construction, the waterproof seal can be easily pushed without deforming the seal by the distal end of the tubular portion 41. Therefore, advantageously, a waterproof effect can be enhanced. Also, the efficiency of the operation can be enhanced as in the above embodiments. Additionally, the stop 42 can be adjusted so as to change the terminal insertion depth.

Figure 7A:
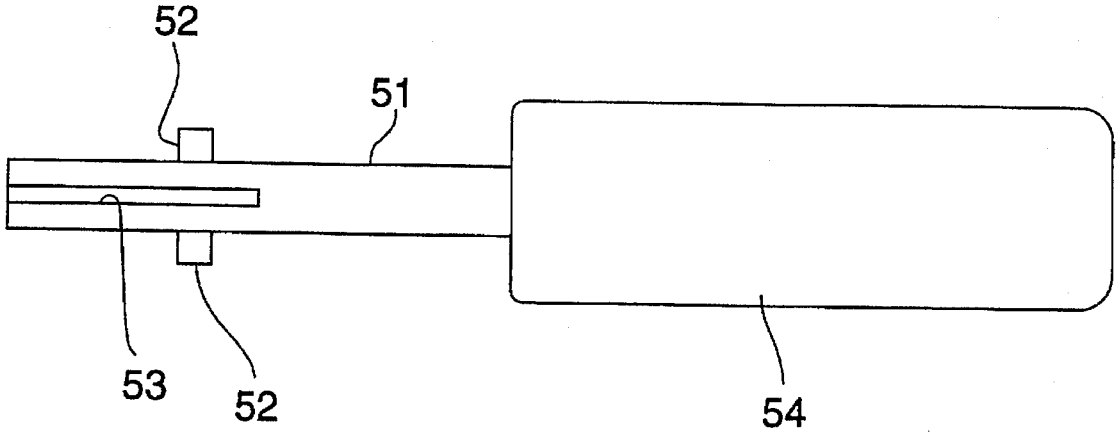
FIG. 7(A) is a side-elevational view showing an overall construction of a fifth embodiment having two projections.
Figure 7B:
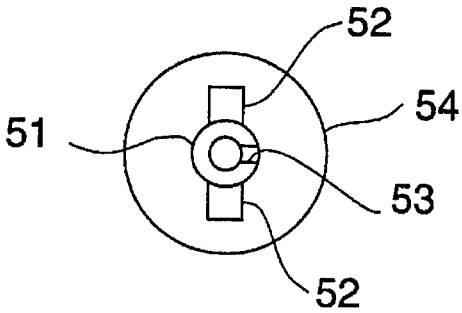
FIG. 7(B) is a front-elevational view of the fifth embodiment.

(4) In the first embodiment, the tubular portion 14 has the stepped configuration and, for example, the cylindrical portion 14*b* serves as a stopper for limiting the depth of insertion of the tubular portion. However, such a construction as shown in FIGS. 7(A) and 7(B) may be adopted.

A tubular portion 51, having a uniform diameter throughout its length from its distal end to its proximal end, extends from one end of a grip portion 54, and a pair of projections 52 are formed respectively on opposite sides of the tubular portion 51 at a predetermined position spaced from the distal end thereof. The projections 52 serve as stoppers. A slit 53 is formed in the tubular portion 51, and extends from the distal end thereof to a position in the vicinity of the projections 52. The slit 53 can receive the wire, which is clamped to the terminal along with the waterproof seal. With this construction, the waterproof seal can be easily pushed without deforming the seal by the distal end of the tubular portion 51. Therefore, advantageously, a waterproof effect can be enhanced. Also, the efficiency of the operation can be enhanced as in the above embodiments.

Figure 8A:
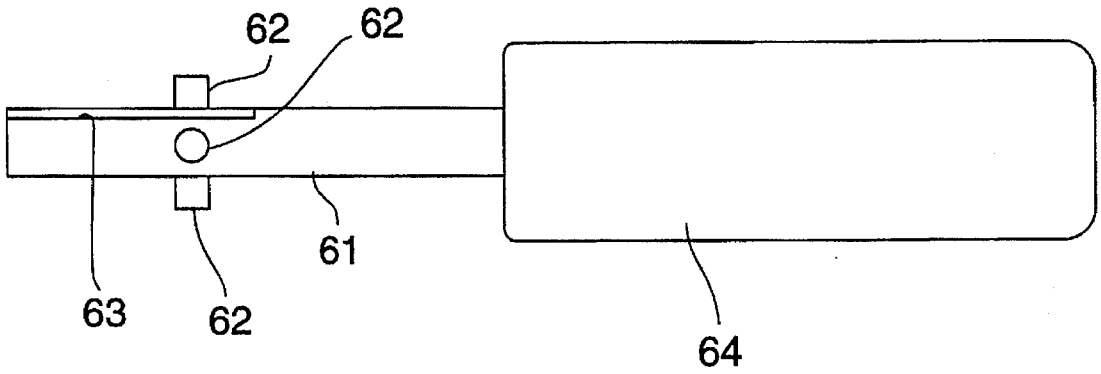
FIG. 8(A) is a side-elevational view showing an overall construction of a sixth embodiment having four projections.
Figure 8B:
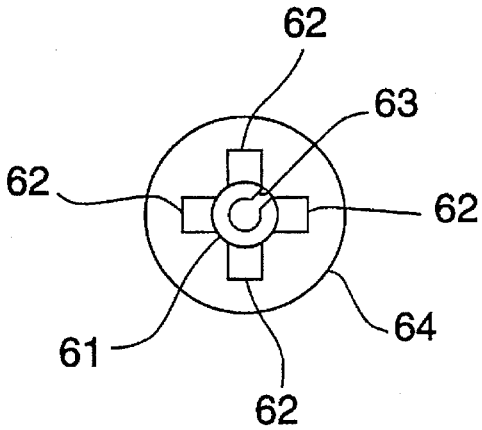
FIG. 8(B) is a front-elevational view of the sixth embodiment.

(5) In the first embodiment, the tubular portion 14 has the stepped configuration and the cylindrical portion 14*b* serves as a stopper for limiting the depth of insertion of the tubular portion. However, such a construction as shown in FIGS. 8(A) and 8(B) may be adopted.

A tubular portion 61, having a uniform diameter throughout its length from its distal end to its proximal end, extends from one end of a grip portion 64, and four projections 62 are formed on a predetermined portion of the tubular portion 61 spaced from the distal end thereof. The four projections are circumferentially spaced at an angle of about 90 degrees from one another. The projections 62 serve as stoppers. A slit 63 is formed in the tubular portion 61, and extends from the distal end thereof to a position in the vicinity of the projections 62. The slit 63 can receive the wire, which is clamped to the terminal together with the waterproof seal. With this construction, the waterproof seal can be easily pushed without deforming the seal by the distal end of the tubular portion 61. Therefore, advantageously, a waterproof effect can be enhanced. Also, the efficiency of the operation can be enhanced as in the above embodiments.

Figure 9:
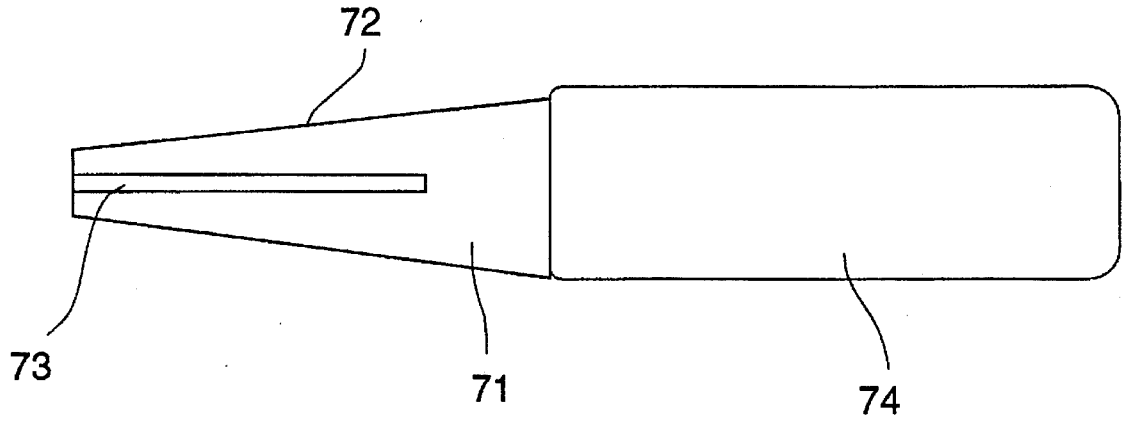
FIG. 9 a side-elevational view showing an overall construction of a seventh embodiment having a tapered tubular portion.

(6) In the first embodiment, although the tubular portion has the stepped configuration, the tubular portion is not limited to such a stepped configuration, and the tubular portion may be tapered toward its distal end in a stepless manner, as shown in FIG. 9.

The invention has been described above with reference to preferred embodiments thereof, which are intended to be illustrative, not limiting. Various other modifications may be made without departing from the scope of the invention as defined in the appended claims.

What is claimed is:

1. A metal terminal insertion tool for inserting a metal terminal through an insertion passage provided in communication with a terminal receiving chamber of a connector housing, said metal terminal having a wire and a waterproof seal connected thereto, said insertion tool comprising:

a tubular portion having a distal end insertable into said insertion passage to engage said waterproof seal, said tubular portion having a slit extending from the distal end thereof, said slit having a width such that said slit can receive said wire therein, wherein an outer diameter of the tubular portion is greater than an inner diameter of the insertion passage such that the distal end of the tubular portion insertable into the insertion passage orients the waterproof seal in a predetermined position within the insertion passage, and wherein the metal insertion tool further comprises a flange connected to said tubular portion such that said slit extends through said tubular portion and said flange.

2. A metal terminal insertion tool according to claim 1, wherein said tubular portion has a stopper for limiting insertion of said tubular portion into said insertion passage.

3. A metal terminal insertion tool according to claim 1, wherein said tubular portion has a stepped configuration such that an outer diameter of said tubular portion is reduced stepwise toward said distal end.

4. A metal terminal insertion tool for inserting a metal terminal through an insertion passage provided in communication with a terminal receiving chamber of a connector housing, said metal terminal having a wire and a waterproof seal connected thereto, said insertion tool comprising:

a tubular portion having a distal end insertable into said insertion passage to engage said waterproof seal, said tubular portion having a slit extending from the distal end thereof, said slit having a width such that said slit can receive said wire therein, wherein an outer diameter of the tubular portion is greater than an inner diameter of the insertion passage such that the distal end of the tubular portion insertable into the insertion passage orients the waterproof seal in a predetermined position within the insertion passage, and wherein said tubular portion comprises a first tubular portion for engaging said waterproof seal, and a second tubular portion having a diameter that is greater than a diameter of said first tubular portion, said first tubular portion having said slit formed completely therethrough and said second tubular portion having said slit formed partially therethrough, said second tubular portion forming a stop so as to limit insertion of said first tubular portion into said insertion passage.

5. A metal terminal insertion tool according to claim 1, further comprising at least one projection formed on said tubular portion, wherein said tubular portion has a substantially constant diameter.

6. A metal terminal insertion tool according to claim 5, wherein said at least one projection comprises at least two projections provided approximately on opposite diametrical sides of said tubular portion.

7. A metal terminal insertion tool according to claim 5, wherein said at least one projection comprises at least four projections formed approximately 90° apart on said tubular portion.

8. A metal terminal insertion tool according to claim 1, wherein said tubular portion has a tapered shape.

9. An insertion tool for inserting a metal terminal and its associated waterproof seal within a connector housing, comprising:

a grip portion; and a tubular portion connected to said grip portion, said tubular portion including a distal end engageable with said waterproof seal, said grip portion being pushed towards said connector housing to insert the metal terminal within the connector housing until a stopper portion formed on said tubular portion engages an insertion port of said connector housing, wherein said tubular portion includes an axial slit for housing a wire extending from said metal terminal during insertion of the metal terminal and its associated waterproof seal into the connector housing, and wherein said tubular portion comprises at least two stepped portions having different diameters and said slit extends at least along said at least two stepped portions.

10. A metal terminal insertion tool according to claim 1, wherein said flange is adjustably mounted on said tubular portion.

11. A method for inserting a metal terminal and its associated waterproof seal through an insertion passage of a connector housing, the method comprising:

engaging a distal end of a tubular portion of said insertion tool with substantially an entire periphery of said waterproof seal; and sliding the metal terminal and said waterproof seal into the insertion passage of the connector housing by pushing a grip portion of said insertion tool, which is attached to said tubular portion, towards an insertion port of said connector housing.

12. A method according to claim 11, further comprising threading a lead wire of said metal terminal within an axial slit in said tubular portion before said engaging of said distal end of said tubular portion.

13. A method according to claim 11, further comprising, prior to said engaging and said sliding, inserting the metal terminal into the insertion passage so that the waterproof seal is located near the insertion port.

14. A method according to claim 11, further comprising, prior to said engaging and said sliding, cutting the tubular portion to a diameter that matches a diameter of the waterproof seal.

* * * * *